US008211144B2

(12) United States Patent
Röhrig

(10) Patent No.: US 8,211,144 B2
(45) Date of Patent: Jul. 3, 2012

(54) TEETH CLEANING PACIFIER HAVING A CONVEX TEAT BODY

(75) Inventor: Peter Röhrig, Vienna (AT)

(73) Assignee: Mam Babyartikel Gesellschaft m.b.H., Vienna (AT)

( * ) Notice: Subject to any disclaimer, the term of this patent is extended or adjusted under 35 U.S.C. 154(b) by 0 days.

(21) Appl. No.: 12/373,602

(22) PCT Filed: Jul. 13, 2007

(86) PCT No.: PCT/AT2007/000348

§ 371 (c)(1),
(2), (4) Date: Jan. 13, 2009

(87) PCT Pub. No.: WO2008/006128

PCT Pub. Date: Jan. 17, 2008

(65) Prior Publication Data

US 2009/0306712 A1 Dec. 10, 2009

(30) Foreign Application Priority Data

Jul. 13, 2006 (AT) ..... A 1192/2006
Jul. 13, 2006 (AT) ..... A 1193/2006

(51) Int. Cl.
*A61J 17/00* (2006.01)

(52) U.S. Cl. ..... 606/235

(58) Field of Classification Search ..... 606/234–236; 119/709–711; 601/139–141; D24/194–196
See application file for complete search history.

(56) References Cited

U.S. PATENT DOCUMENTS

| | | | | |
|---|---|---|---|---|
| 2,520,773 | A | 8/1950 | Muller | |
| 3,924,621 | A * | 12/1975 | Cassimally | 606/236 |
| D245,335 | S * | 8/1977 | Meeker et al. | D24/194 |
| 4,381,785 | A * | 5/1983 | Robbins | 606/236 |
| 4,403,613 | A * | 9/1983 | Panicci | 606/236 |
| 5,004,473 | A * | 4/1991 | Kalantar | 606/234 |
| 5,653,731 | A * | 8/1997 | Rohrig | 606/234 |
| 5,711,759 | A | 1/1998 | Smith et al. | |
| 6,325,817 | B1 * | 12/2001 | Shen | 606/236 |
| 7,144,416 | B2 | 12/2006 | Struckmeier et al. | |

(Continued)

FOREIGN PATENT DOCUMENTS

CH 315 459 A 8/1956

(Continued)

OTHER PUBLICATIONS

International Search Report: PCT/AT2007/000348.

*Primary Examiner* — Elizabeth Houston
(74) *Attorney, Agent, or Firm* — Ladas & Parry LLP

(57) ABSTRACT

A pacifier with a shield and a teat element. The teat element includes a shaft adjacent to the shield and solid in cross-section in the region of contact with the jaw and/or the teeth. A teat member adjoins the shaft in its end section which faces away from the shield so that the contour of the teat element, starting from the shaft, has a club-shape which corresponds substantially to known hollow-body teats. A convex hollow teat body is provided as a teat member which is substantially annular. The longitudinal axis of the annular teat body runs substantially perpendicularly to the longitudinally extending axis of the teat element or the hollow teat body is designed to be substantially closed-walled so as to form a cavity.

12 Claims, 6 Drawing Sheets

U.S. PATENT DOCUMENTS

| | | | |
|---|---|---|---|
| D565,737 | S | 4/2008 | Rohrig |
| 7,753,225 | B2 | 7/2010 | Röhrig |
| 2004/0210252 | A1 | 10/2004 | Minoguchi et al. |

FOREIGN PATENT DOCUMENTS

| | | | |
|---|---|---|---|
| DE | 828 288 | | 1/1952 |
| DE | 43 18 693 | B4 | 12/1994 |
| DE | 200 01 256 | U1 | 4/2000 |
| DE | 102 27 787 | A1 | 10/2003 |
| EP | 1 424 057 | A1 | 6/2004 |
| FR | 1 463 140 | A | 3/1967 |
| GB | 130747 | | 8/1919 |
| GB | 2 278 549 | A | 12/1994 |
| JP | 54-94600 | U | 7/1979 |
| JP | 2001-276186 | A | 10/2001 |
| JP | 2006-513105 | A | 4/2006 |
| WO | 96/20687 | A1 | 7/1996 |
| WO | 98/02132 | A1 | 1/1998 |
| WO | 98/27928 | A1 | 7/1998 |
| WO | 99/04745 | A1 | 2/1999 |
| WO | 02/064079 | A1 | 8/2002 |
| WO | 2004/064578 | A1 | 8/2004 |
| WO | 2004/087039 | A1 | 10/2004 |

* cited by examiner

TEETH CLEANING PACIFIER HAVING A CONVEX TEAT BODY

BACKGROUND OF THE INVENTION

The invention relates to a pacifier with a shield and a teat element, wherein the teat element includes a shaft adjacent to the shield and solid in the cross-section in the region of contact with the jaw and/or the teeth, wherein a teat member adjoins the shaft in its end section which faces away from the shield so that the contour of the teat element, starting from the shaft, has a club-shape which corresponds substantially to known hollow-body teats.

A number of different pacifiers has been known, wherein a teat element is fixed to a shield. Here, these are teat elements which consist of a hollow body so that the hollow body deforms elastically when a suction is being applied by the child, with the cavity enclosed by the teat walls thus being reduced. If the baby or infant using the pacifier does not apply any suction on the hollow body, the latter will reassume its initial shape. This usual shape of hollow-body teats substantially corresponds to a club-shape, i.e. a shaft section via which the hollow-body teat is connected to the shield having at comparably small cross-section and broadening into a freely cantilevering nipple member which consequently has a comparably large cross-section.

However, the use of such pacifiers by babies and infants has the negative effect that the teeth rows of the baby or infant cannot be fully closed in the region of the shaft of the pacifier. Frequently, this causes a frontally-open bite, i.e. a mal-position of the teeth of the growing child.

In order to avoid the frontally-open bite, the prior art has proposed different solutions.

In particular, it has been known from WO 99/04745 A to provide a conventional hollow-body teat with a comparably planar transmitter body which is angled so that the transmitter body can be received between the upper and lower incisors of an infant, thus trying to substantially allow for a closing of the incisors. Due to the design of the teat as a hollow-body, however, also this angled transmitter body has to be double-walled so that a comparably high wall thickness also results in the region of the transmitter body which is planar compared to the remaining parts of the teat.

A similar solution has also been described in WO 98/02132 A, yet, here, a special teat body is provided which, in its used position, is arranged beneath the lip of the baby or the infant so as to allow for lip contact with the upper palatal area.

FR 1 463 140 A shows a pacifier which is designed to be integral with a shield and which has a shaft region solid in its cross-section. A teat element, which is likewise solid in cross-section, adjoins the plate-shaped shaft region so that there will be no suction feeling which substantially corresponds to that of a usual hollow-body teat.

A different dental-hygiene device has been known from U.S. Pat. No. 5,711,759 A, wherein also here a shaft solid in cross-section is provided in the region of teeth contact, with a massage part which is club-shaped and likewise solid in cross-section adjoining thereto. Moreover, a number of massage and/or cleaning elements is provided on the massage element.

Another pacifier has been known from CH 315 459 A which is completely solid in cross-section. Consequently, no suction feeling will be achieved either which corresponds to that of a hollow-body teat.

Further specific orthodontic hollow-body teats have been known, e.g. from DE 102 27 787 A, DE 43 18 693 A as well as DE 828 288 C. Yet, also here, due to the double-wall design of the hollow body, the wall thickness of the hollow-body teat is limited downwards in the region of contact with the jaw and/or teeth.

Furthermore, a specific bite device has been known from US 2004/0210252 A1 for strengthening the teeth of children and babies, wherein, here, a teat and/or bite element is fixed to a shield. Nevertheless, this is no pacifier in the conventional sense with a club-shaped teat element but a disk-shaped teat and/or bite element.

The object of the present invention resides in creating a pacifier of the above kind which can be designed to be thin in the teeth-closing region and/or in the jaw-contact region and which, at the same time, gives a suction feeling substantially corresponding to that of known hollow-body teat.

With the pacifier of the initially defined kind this is achieved in that a convex bellied teat body is provided as a teat element which forms a cavity. The measure of providing a solid-walled or single-walled shaft, i.e. a shaft which is not hollow-walled as is the case with usual hollow-body teats, allows for the wall thickness of the shaft to be reduced so that the shaft has an extremely thin material thickness in the jaw and/or teeth-contact region of the teat element. Moreover, at least one hollow, convex teat body is provided on the shaft so that the contour of a conventional hollow-body teat can be imitated, and that a suction feeling which substantially corresponds to that of conventional hollow-body teats also results for the baby or the infant using the pacifier. Here, the teat element arranged on the shaft has the same elasticity as a usual hollow-body teat.

In order to create a cavity-enclosing teat element with an elasticity which substantially corresponds to that of usual hollow-body teats, it is beneficial if the teat is substantially annular, wherein the longitudinal axis of the annular teat body is provided to be substantially perpendicular to the longitudinally extending axis of the teat element. Alternatively, it is likewise possible to design the teat body to form the cavity to be substantially closed-walled on all sides.

It is beneficial if a number of massage and/or cleaning elements is provided on the shaft so as to obtain a massage of the jaw and/or a cleaning of the primary teeth of the infant, in addition to the calming effect of the suctioning at the teat element connected to the shaft.

As regards a form-stable retention of the teat element above the shaft as well as an efficient massage and/or cleaning by means of massage and/or cleaning elements possibly arranged on the shaft, it is beneficial if the shaft is designed to be substantially plate-shaped.

As regards an efficient massage and/or cleaning of the palate and/or the teeth, it is beneficial if the massage and/or cleaning elements are arranged to be substantially perpendicular to the plate-shaped shaft. Here, it has proven to be advantageous if knob-shaped pins are provided as massage and/or cleaning elements. Alternatively, to achieve an efficient massage and/or cleaning, it is also possible to provide teeth-shaped pins as massage and/or cleaning elements.

In order to allow for a pressure equalization between the substantially closed-walled, convex or lenticular teat body after a suction force has been applied by a baby or infant, it is advantageous if a slot-shaped opening is provided in a freely cantilevering end section of the closed-walled teat body. Alternatively, a pressure equalization of the closed-walled teat body may also be achieved if, advantageously, a ventilation channel is provided which extends from the cavity of the closed-walled teat body across the shaft to the outer side of the shield.

If a longitudinal axis of the teat body is arranged to be inclined, preferably at an angle of between 30° and 60°, towards the longitudinal axis of the shaft, there results an angled teat element which is preferred by some infants.

In order to avoid the risk of a frontally open bite and, at the same time, to meet the requirements as to bite strength, it has proven to be advantageous if the wall thickness of the shaft ranges between 0.8 mm and 3 mm, preferably 1.7 mm and 2.4 mm.

In order to increase the elasticity of the shaft transversely to its longitudinal extension, it is beneficial if the shaft has at least one material tapering which runs transversely to its longitudinal extension. Alternatively to the material tapering, the shaft could also be bent or wavy.

The elasticity of conventional hollow-body teats is particularly provided if the teat element consists of silicone, latex or a thermoplastic elastomer. The shield, to the contrary, is provided with the necessary strength if it advantageously consists of a thermoplastic material, in particular polycarbonate or polypropylene.

As regards a reliable fixing of the teat element on the shield as well as a cost-effective production, it is beneficial if the shield and the teat element are designed to be an integral two-component or multi-component injection molding part.

BRIEF DESCRIPTION OF THE DRAWING FIGURES

In the following, the invention will be explained in even more detail by way of the preferred exemplary embodiments illustrated in the drawings, yet without being restricted thereto. In detail, in the drawings.

Figure 3:
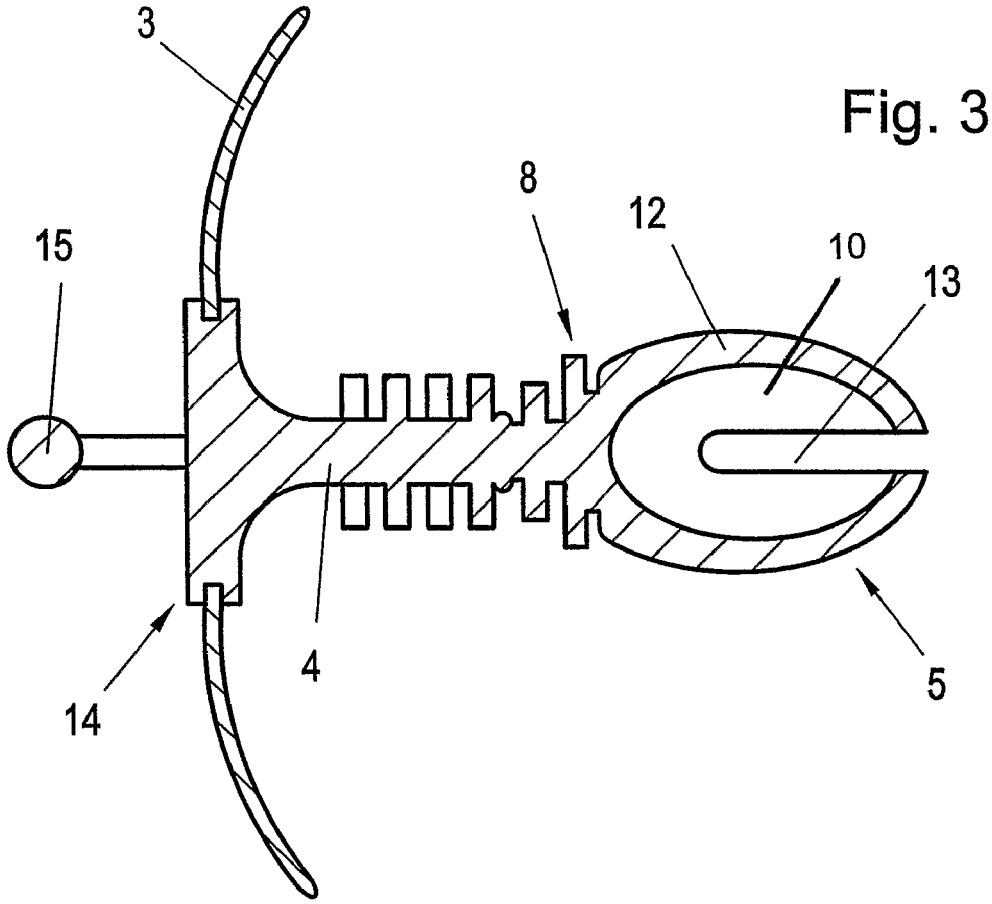
FIG. 3 shows a sectional representation along line III-III of FIG. 2.
Figure 3A:
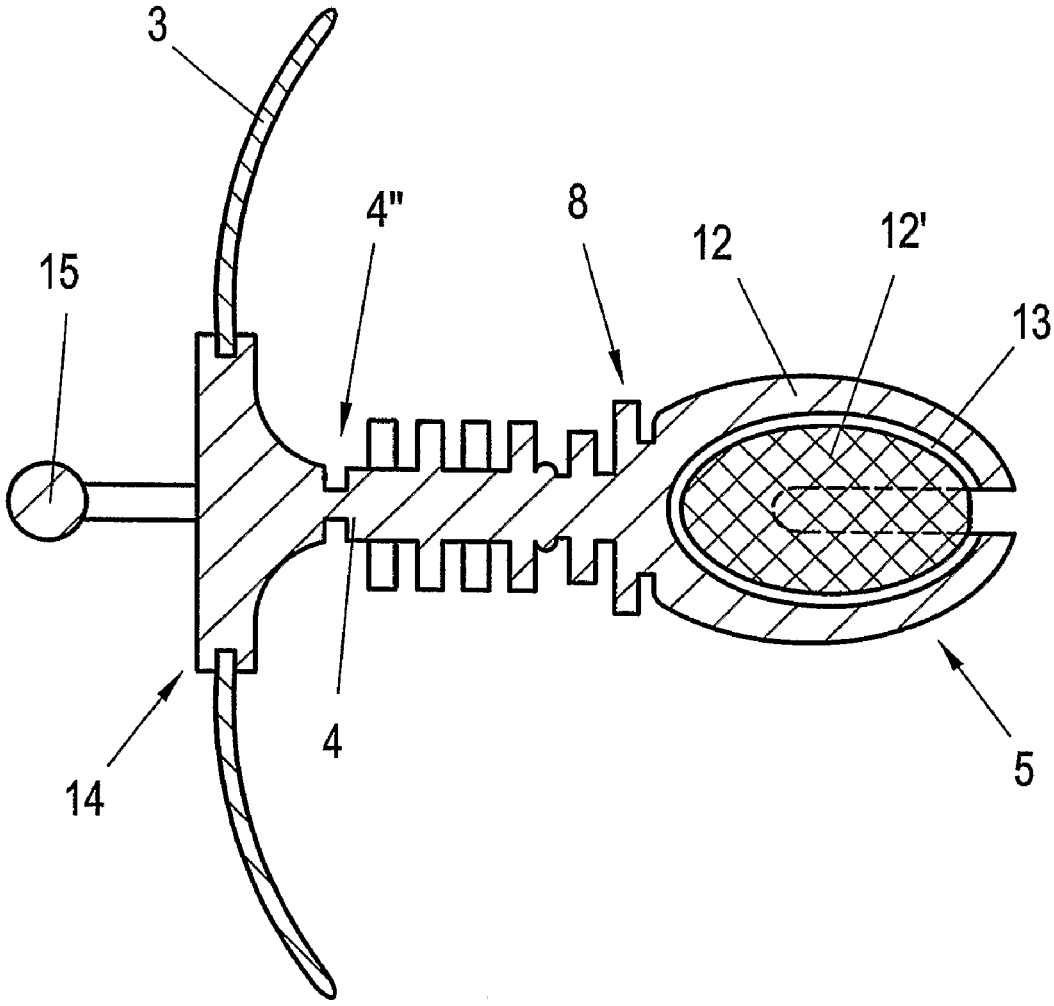
Figure 4:
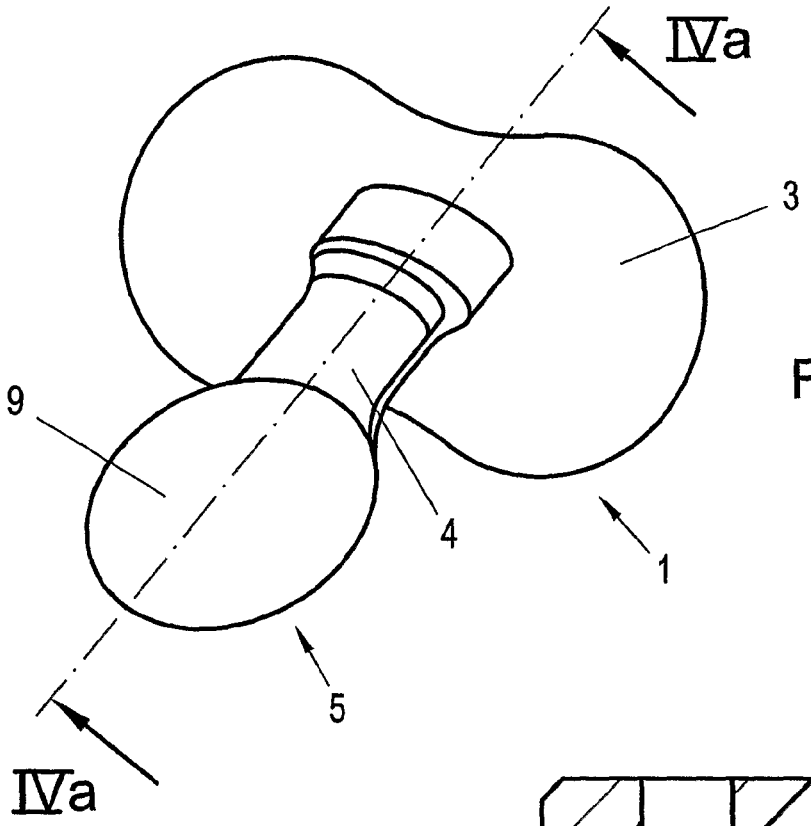
Figure 4A:
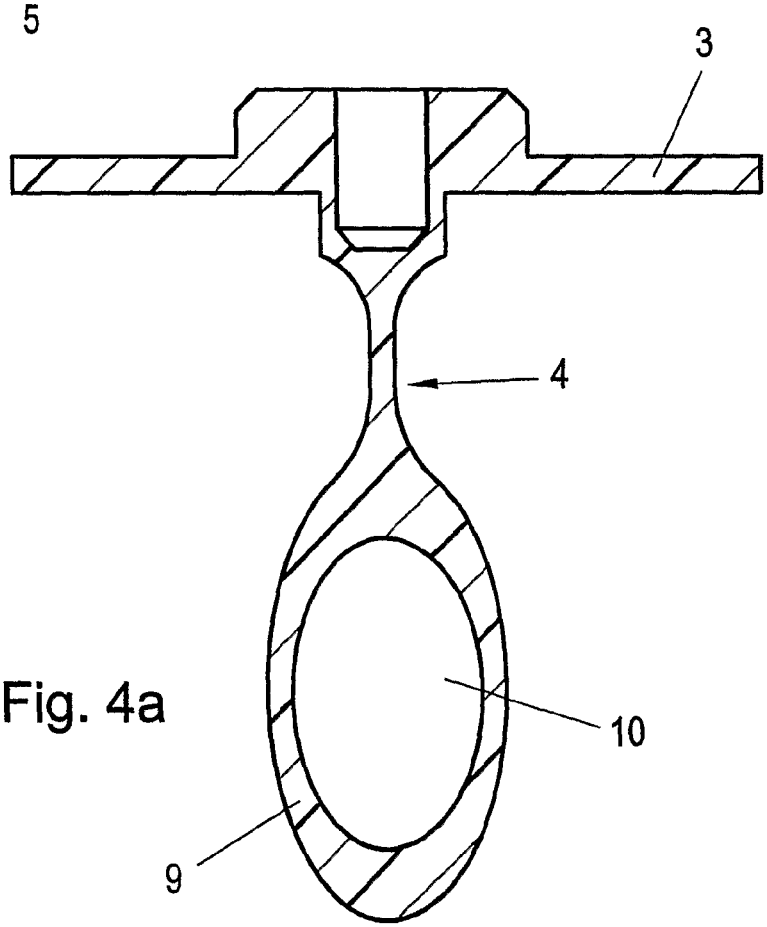
Figure 5:
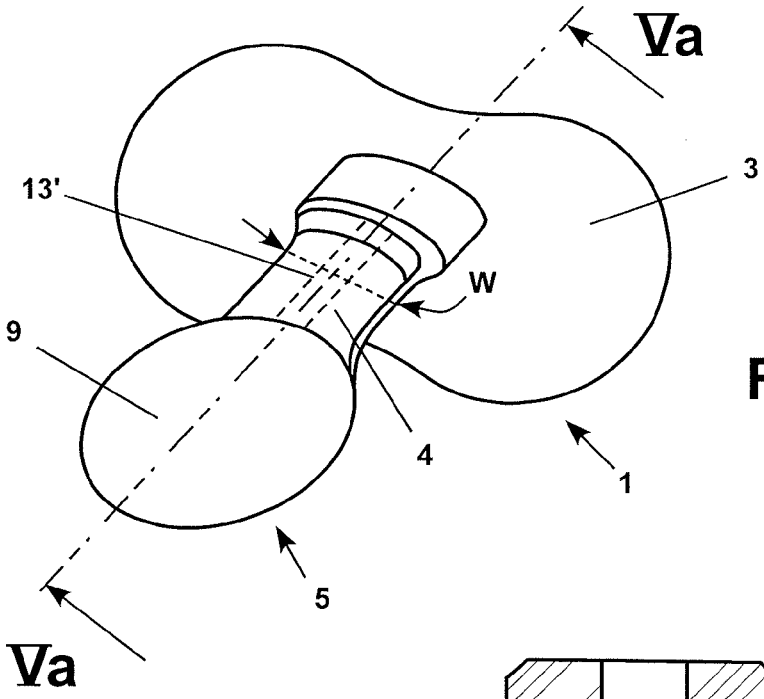
Figure 5A:
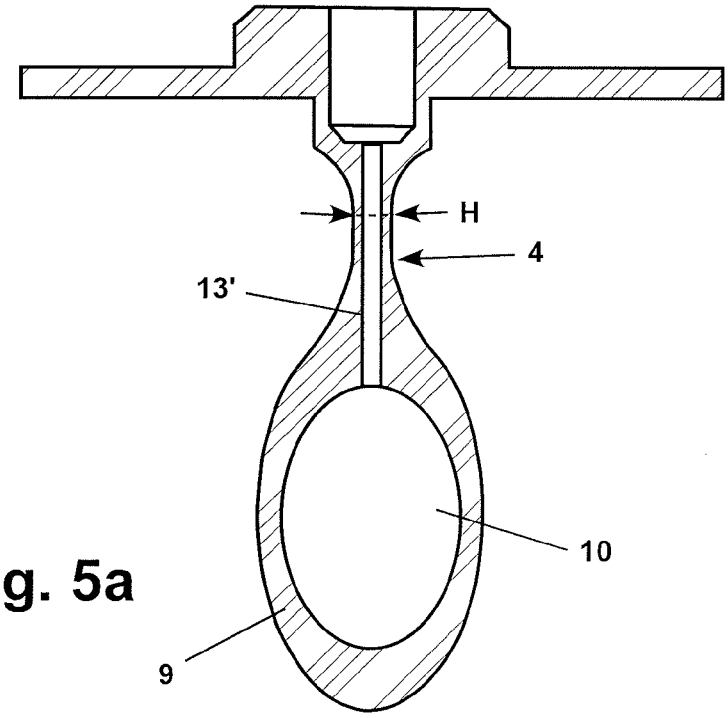
Figure 6:
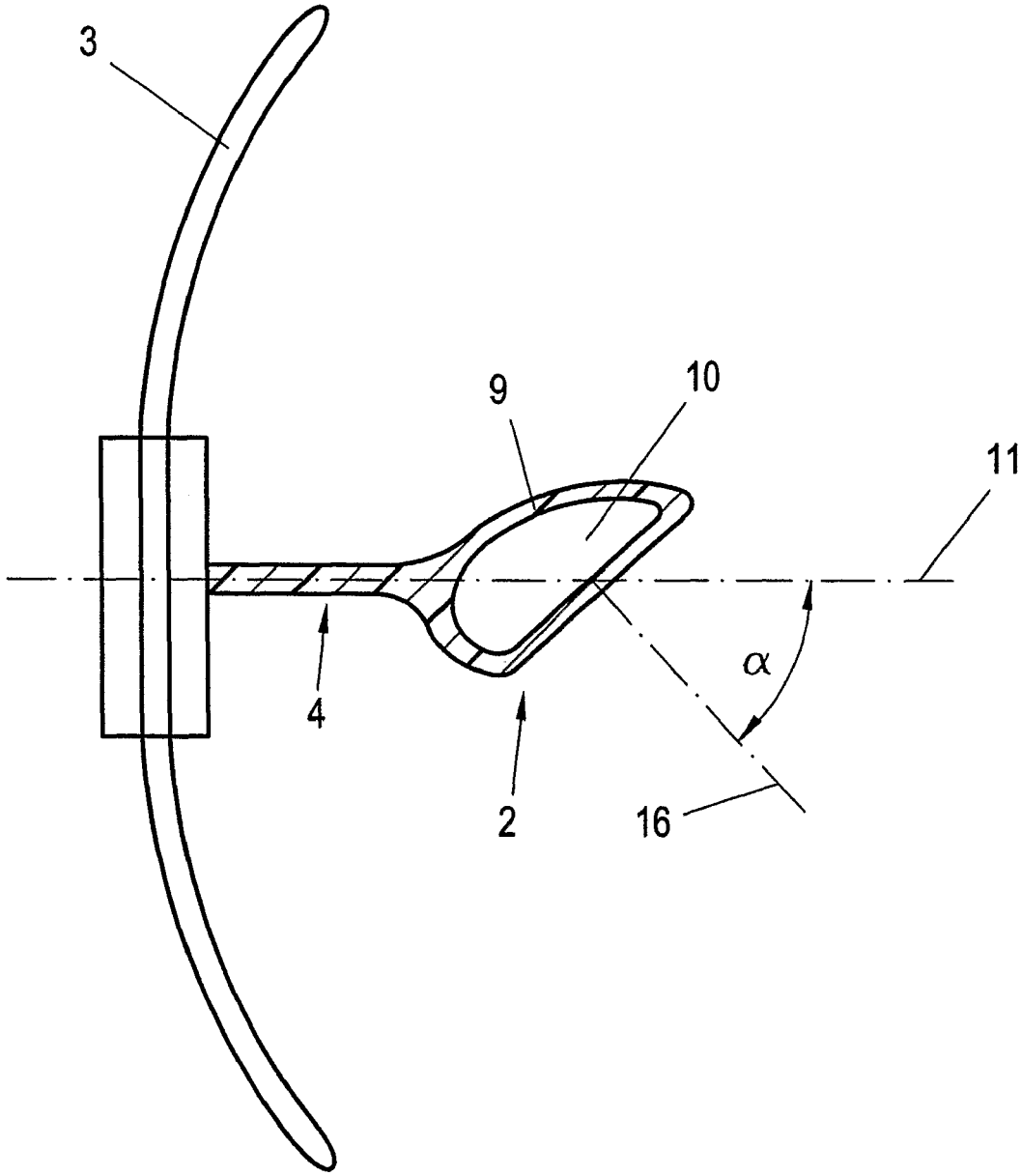

FIG. 3*a* shows a sectional representation according to FIG. 3, wherein an insert is received in the convex teat element;

FIG. 4 shows a perspective view of a teat with a shaft that is solid in cross-section, a substantially closed-walled, convex teat element being connected thereto, wherein the surfaces are substantially smooth;

FIG. 4*a* shows a sectional representation along line IVa-IVa of FIG. 4;

FIG. 5 shows a perspective view of a teat similar to FIG. 4 but including a ventilation channel that extends through the shaft;

FIG. 5*a* shows a sectional representation along line Va-Va of FIG. 5; and FIG. 6 shows a perspective view of a teat similar to FIG. 4 but including an angled teat body.

DETAILED DESCRIPTION OF THE PREFERRED EMBODIMENTS

Figure 1:
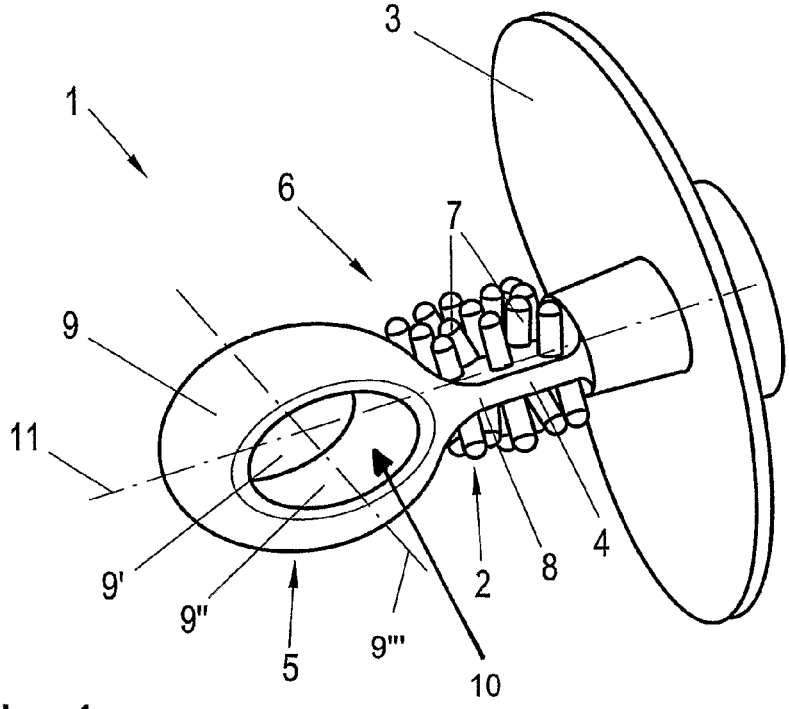
FIG. 1 shows a perspective view of a teat with a solid shaft, with an annular, convex teat element being connected thereto.

In FIG. 1, a pacifier 1 is shown with a teat element 2 which is fixed to a shield 3, wherein the teat element 2 and the shield 3 may also be produced to be integral with a double-component or multi-component injection molding process. Here, the teat element 2 has a solid shaft 4 arranged adjacent to the shield 3. In the region of the shaft 4, the jaw and/or the incisors of a baby or infant using the pacifier 1 come(s) to rest so that the solid or single-walled shaft 4 is as thin-walled as possible, e.g. of a wall thickness of about 2.4 mm so as to prevent an open frontal bite of the baby or infant and, at the same time, meet the requirements as regards bite strength.

Figure 2:
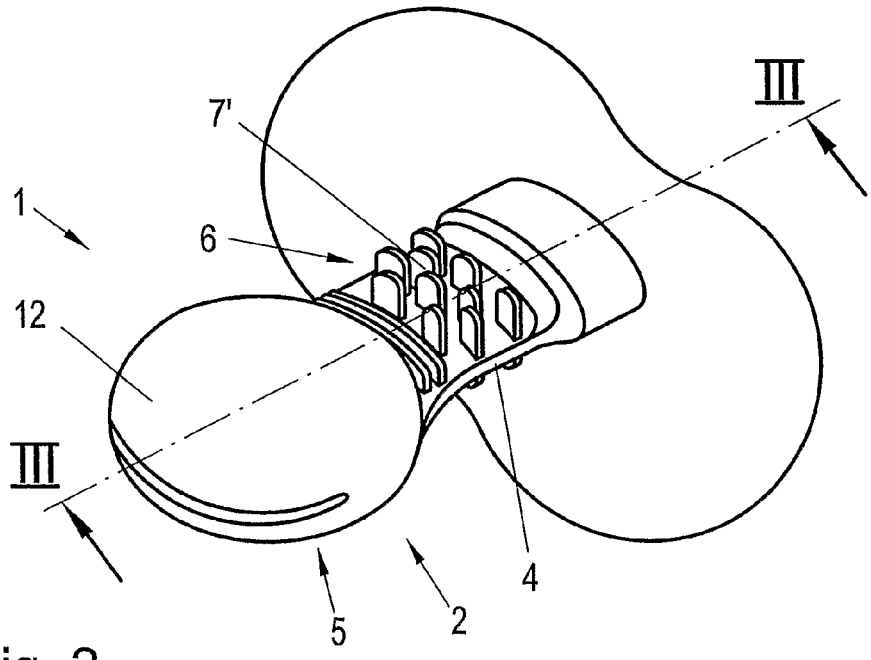
FIG. 2 shows a perspective view of a teat with a shaft that is solid in cross-section, a substantially closed-walled, convex teat element being connected thereto.

In the exemplary embodiment showing in FIGS. 1 and 2, the shaft 4 is designed to be substantially plate-shaped. Certainly, this shaft 4 may also have a different shape, e.g. substantially the shape of a stem or a thorn. Thus, the shaft 4 is substantially just a base structure for fixing a teat member 5 and/or massage and/or cleaning elements 6 so that the contour of the pacifier 1 corresponds substantially to that of known hollow-body teats.

In the exemplary embodiment shown in FIG. 1, the plate-shaped shaft 4 has knob-shaped pins 7, which serve as massage and/or cleaning elements 6, on either broadside, so that the pacifier 1, at the same time, allows for the conventional calming effect and for a massage of the palate and/or a cleaning of the incisors.

The plate-shaped shaft 4 bifurcates in its end section 8 which faces away from the shield 3, wherein a substantially annular, convex teat body 9 is provided on the shaft 4 as a teat member 5. The annular teat body 9 adjoins a cavity 10 and, here, it has lateral ring openings 9', 9", wherein a ring axis 9''' runs substantially perpendicularly to the longitudinally extending axis 11 of the pacifier 1 and in parallel to the plane on which the shield 3 extends. Thus, like a conventional hollow-body teat, the annular teat body 9 exhibits a certain elasticity so that it will contract when a suction pressure is being applied by the baby or infant and will reassume its initial position (FIG. 1) if this suction pressure is not applied.

FIGS. 2 and 3 show an alternative exemplary embodiment of the pacifier 1, wherein also here the teat element 2 is connected to the shield 3 via a plate-shaped shaft 4. Here, substantially teeth-shaped pins 7' are provided on the broadsides of the plate-shaped shaft 4 as massage and/or cleaning elements 6.

As is particularly visible from FIG. 3, a convex teat member 5, which has the form of a substantially closed-walled, lenticular or cherry-shaped body 12 respectively, adjoins the shaft 4 in its front end section 8 facing away from the shield 2. Here, the closed-walled body 12 has a slot-shaped opening 13 in its freely-cantilevering front-sided end section. Also this results in the club-shape known from conventional hollow-body teats, as is particularly visible from FIG. 3, so that the suction feeling of known hollow-body teats can largely be imitated; nevertheless, the single-walled thin design of the shaft 4 at the same time allows for a smaller wall thickness to be achieved in the region of contact with the jaw and/or the teeth.

As can further be seen from FIG. 3, the teat element 2 may also comprise a fixing flange 14 as well as a gripping member 15, wherein the shield 3 is snapped into a groove of the fixing flange 14. Alternatively, all exemplary embodiments shown may also be designed to be integral by means of a two-component injection-molding process, wherein the teat element 2, compared to the shield 3, consists of a soft material, e.g. silicone, latex, a thermoplastic elastomer or the like.

In FIG. 3*a* it can be seen that a sponge-like insert 12' may be received by the substantially closed-walled hollow body 12. This insert 12' allows for saliva of the child using the pacifier 1 to be collected so as to allow for the collected saliva fluid to be examined, in particular for medical purposes. Moreover, a material tapering 4" of the shaft 4 is visible which is formed by transverse grooves provided on either side so that the shaft 4 can be bent downwards and/or upwards in a simple manner transversely to its longitudinally extending direction.

In FIG. 4, a further exemplary embodiment with a convex closed-walled teat body 9 can be seen, wherein the surfaces are designed to be substantially smooth both in the region of the shaft 4 and in the region of the teat body 9. As is visible from FIG. 4*a*, the teat body 9 encloses a cavity 10.

In FIGS. 5 and 5*a* it can be seen that a ventilation of the convex, substantially closed-walled teat body 9 can also be achieved via a ventilation channel 13' which establishes a connection from the cavity 10 to the outer side of the shield 3. In FIG. 5 is further illustrated a larger extension across a first cross sectional axis or the width of the shaft, designated "W"; and in FIG. 5*a* is illustrated the height of the shaft or the second shorter extension in the direction of a second cross sectional axis designated "H".

FIG. 6 shows a further exemplary embodiment, wherein a teat body 9 is provided which is convex, has a flattened tip, forms the cavity 10 and has an axis 16 running perpendicularly to the flattened tip. The axis 16 is arranged at an angle of about 45° relative to the longitudinal axis 11 of the shaft 4. This results in asymmetric angled design of the teat element 2. In order to allow for a pressure equalization of the cavity 10, also this teat body 9 may include, e.g. lateral openings (9', 9") for forming an annular teat body 9 (cf. FIG. 1) or may also have a slot-shaped opening 13 (cf. FIG. 3) or a ventilation channel 13' (cf. FIG. 5). What is important here is that the shaft 4 is massive in its cross-section and that a convex hollow teat body 9, 12 is provided so as to achieve a suction feeling which corresponds substantially to that of a conventional hollow-body teat.

The invention claimed is:

1. A pacifier with a shield and a teat element, wherein the teat element includes a shaft adjacent to the shield, wherein a teat member adjoins the shaft in its end section which faces away from the shield wherein a convex teat body is provided as teat member which is substantially closed-walled and forms a cavity, such that the contour of the teat element starting from the shaft has a club-shape which corresponds substantially to known hollow-body teats, wherein the shaft is designed to be substantially plate-shaped with a first larger extension in the direction of a first cross-sectional axis and a second shorter extension in the direction of a second cross-sectional axis and wherein the shaft is solid in cross-section in a region of contact with a jaw and/or teeth except for a ventilation channel, wherein a wall thickness of the shaft in the direction of the first cross-sectional axis of the shaft is larger than a wall thickness of the shaft in the direction of the second cross-sectional axis of the shaft, wherein the ventilation channel adjoins the cavity via a first, larger stepped reduction in cross-section in the direction of the first cross-sectional axis of the shaft and via a second smaller stepped reduction in cross-section in the direction of the second cross-sectional axis of the shaft, respectively, and wherein the ventilation channel extends in the plate-shaped shaft from the cavity of the closed-walled teat body to an outer side of the shield.

2. The pacifier according to claim 1, wherein a number of massage and/or cleaning elements is provided on the shaft.

3. The pacifier according to claim 2, wherein the massage and/or cleaning elements are arranged to be substantially perpendicular to the plate-shaped shaft.

4. The pacifier according to claim 1 or 2, wherein knob-shaped pins are provided as massage and/or cleaning elements.

5. The pacifier according to claim 1 or 2, wherein teeth-shaped pins are provided as massage and/or cleaning elements.

6. The pacifier according to claim 1, wherein a longitudinal axis of the teat body is arranged to be inclined, preferably at an angle of between 30° and 60°, towards the longitudinal axis of the shaft.

7. The pacifier according to claim 1, wherein the wall thickness of the shaft ranges between 0.8 mm and 3 mm, preferably 1.7 mm and 2.4 mm.

8. The pacifier according to claim 1, wherein the shaft has at least one material tapering which runs along its longitudinal extension.

9. The pacifier according to claim 1, wherein the teat element consists of silicone, latex or a thermoplastic elastomer.

10. The pacifier according to claim 1, wherein the shield consists of a thermoplastic material, in particular polycarbonate or polypropylene.

11. The pacifier according to claim 1, wherein the shield and the teat element are designed to be an integral two-component or multi-component injection molding part.

12. The pacifier of claim 1, wherein the wall thickness of the shaft in the direction of the first cross-sectional axis of the shaft is significantly larger than the wall thickness of the shaft in the direction of the second cross-sectional axis of the shaft.

* * * * *